US007077069B2

(12) United States Patent
Oomura et al.

(10) Patent No.: US 7,077,069 B2
(45) Date of Patent: Jul. 18, 2006

(54) U-TYPE SLAG-TAP FIRING BOILER AND METHOD OF OPERATING THE BOILER

(75) Inventors: Yoshitaka Oomura, Funabashi (JP); Takashi Yoshiyama, Kakogawa (JP); Chikatoshi Kurata, Chiba (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/491,149

(22) PCT Filed: Oct. 4, 2002

(86) PCT No.: PCT/JP02/10384

§ 371 (c)(1),
(2), (4) Date: Mar. 26, 2004

(87) PCT Pub. No.: WO03/031873

PCT Pub. Date: Apr. 17, 2003

(65) Prior Publication Data

US 2004/0237862 A1 Dec. 2, 2004

(30) Foreign Application Priority Data

Oct. 5, 2001 (JP) ..... 2001-309640
Sep. 12, 2002 (JP) ..... 2002-267269

(51) Int. Cl.
*F23D 1/00* (2006.01)

(52) U.S. Cl. ..... 110/348; 110/266; 110/188; 110/347

(58) Field of Classification Search ..... 110/348, 110/266, 188, 347
See application file for complete search history.

(56) References Cited

U.S. PATENT DOCUMENTS 6,058,855 A 5/2000 Ake et al.
6,622,645 B1 * 9/2003 Havlena ..... 110/348

FOREIGN PATENT DOCUMENTS

| | | | |
|---|---|---|---|
| DE | 1102333 | | 10/1961 |
| DE | 38 05 943 | A1 | 8/1989 |
| DE | 271 941 | A1 | 9/1989 |
| DE | 39 43 084 | A1 | 7/1991 |
| EP | 0 159 492 | A2 | 3/1985 |
| EP | 0 301 714 | A2 | 2/1989 |
| JP | A 61-165518 | | 7/1986 |
| JP | A 62-102008 | | 5/1987 |
| JP | A-64-054103 | | 3/1989 |
| JP | A 1-111108 | | 4/1989 |
| WO | WO 87/06677 | A1 | 11/1987 |

* cited by examiner

*Primary Examiner*—Kenneth Rinehart
(74) *Attorney, Agent, or Firm*—Oliff & Berridge, PLC

(57) ABSTRACT

A boiler includes a coal pulverizer that pulverizes coal; a coal combustion unit that combusts gasified pulverized coal that has been pulverized by the coal pulverizer; a furnace that combusts gasified fuel generated by the coal combustion unit; a slag formation unit provided in an ash outlet of the coal combustion unit; means for supplying primary air, for supply of the pulverized coal; to the coal pulverizer; means for supplying secondary air, for gasified combustion, to the coal combustion unit; and means for supplying tertiary air, for gasified fuel combustion, to the furnace.

18 Claims, 8 Drawing Sheets

U-TYPE SLAG-TAP FIRING BOILER AND METHOD OF OPERATING THE BOILER

TECHNICAL FIELD

The present invention relates to a pulverized-coal-fired U-type slag-tap firing boiler that maintains high combustion temperatures near fluid temperature by firing pulverized coal to melt ash in molten slag and discharges granulates, and to a method of operating the boiler mentioned-above.

BACKGROUND ART

Referring to FIG. 7, a conventional U-type slag-tap firing boiler includes a combustion furnace 105 including a combustion chamber 101 having water-cooled walls coated with a refractory liner of a refractory material, burners 102 installed to the ceiling of the combustion chamber 101 in a vertical position, a slag-tap 103 formed at the bottom of the combustion chamber 101 to discharge molten slag, and a slag screen 104 formed by arranging multiple screen tubes 104*a*. The slag screen 104 is disposed in a sectional shape shown in FIG. 8 at a position, where flames flowing downward through the combustion chamber 101 start flowing upward, of the combustion chamber 101. The boiler also includes a convection heat transfer unit 107 including a radiant furnace 106 having exposed steel walls and disposed below the combustion furnace 105 with respect to the flowing direction of flames, and superheater tubes.

The slag screen 104 separates the combustion furnace 105 and the radiant furnace 106 to prevent temperature drop in the combustion chamber 105 due to heat transfer by thermal radiation from the combustion furnace 105 into the radiant furnace 106, and to reduce load on downstream members by arresting ash contained in the combustion gas. The slag screen 104 is an essential component of the U-type slag-tap firing boiler for low-$NO_x$ operation. Moreover, a slag quenching water bath 108 provided with a slag conveyor 109 therein, a pressure-measuring nozzle 110 installed to the combustion chamber 101, a pressure-measuring nozzle 111 installed to the radiant furnace 106, and tertiary nozzle 112 installed to the combustion chamber 101 to stage air into the combustion chamber 101 for two-staged combustion are shown in FIG. 7.

The refractory liner of the combustion furnace 105 coats a portion of the inner surface of the combustion furnace 105 extending from a part around the burners 102 through the slag screen 104 to an inclined part of the combustion chamber 105 below the slag screen 104. Coal ash deposited on the refractory liner melts in molten slag, the molten slag flows and is maintained at high temperatures around the fluid temperature. The thickness of a slag layer formed on the inner surface of the combustion furnace 105 changes according to the fluid temperature of the coal ash or the hemispherical temperature. Thus, the thickness of the slag layer is dependent on coal characteristic or on load.

Techniques relating to this conventional U-type slag-tap firing boiler are mentioned in U.S. Pat. No. 6,058,855.

The following methods have been taken in an attempt to achieve the low-$NO_x$ operation of conventional U-type slag-tap firing boilers.

(1) Recirculation of the exhaust gas (2) Blowing air into the combustion furnace for a tertiary combustion in addition to air blown into the combustion furnace by the burners (3) Reduction of the particle size of pulverized coal (4) Fuel reburning Techniques relating to (2) blowing air into the combustion furnace for a tertiary combustion will be explained. It is known that low-$NO_x$ operation can be achieved by reducing burner air ratio. For example, the conventional U-type slag-tap firing boiler shown in FIG. 7 is reducing the rate of supply of air to the burners 102 such that burner air ratio is on the order of 0.8. However, if burner air ratio is reduced to about 0.8, the amount of heat generated in the combustion furnace 105 decreases by about 30%, the temperature in the combustion furnace 105 drops about 100° C., and the thickness of the slag layer is multiplied by 1.5 to 1.6. Consequently, the temperature of the discharged slag drops, the slag cannot be stably discharged, the deposition of the slag on the screen tubes 104*a* of the slag screen 104 increases, the apparent outside diameter of the screen tubes 104*a* coated with a slag layer increases, and clinker grows in part of the screen tubes 104*a*, thereby, continuous operation becomes difficult. Therefore, when burner air ratio for the conventional U-type slag-tap firing boiler is reduced to about 0.8, air needs to be blown into a space above the slag screen 104 for second-stage combustion to maintain air ratio at the slag screen 104 at 1.

In the conventional U-type slag-tap firing boiler, air needs to be blown into the space above the slag screen 104 for second-stage combustion to maintain air ratio at the slag screen 104 at 1 for the complete combustion of coal in order to prevent plugging of the slag-tap 103 for discharging molten slag due to temperature drop in the combustion furnace and plugging of the slag screen 104 due to clinker growth on the screen tubes 104*a*. Consequently, it has been difficult to achieve satisfactory low-$NO_x$ operation. The $NO_x$ concentration at the exit of the U-type slag-tap firing boiler is in the range of 400 to 500 ppm (in case of 6% $O_2$) at the lowest when techniques relating to the methods (1), (2) and (3) are used in combination, and 150 ppm (in case of 6% $O_2$) at the lowest when techniques relating the methods (1), (2), (3) and (4) are used in combination. Thus, a $NO_x$ removal system needs to be connected to the exit of the boiler to keep a limit $NO_x$ concentration prescribed in air pollution control laws.

The amount of $NO_x$, i.e., a pollutant that causes environmental pollution, is dependent on an oxidizing atmosphere or a reducing atmosphere bounded by an air ratio of 1, and combustion temperature. The amount of $NO_x$, is larger at higher temperatures in an oxidizing atmosphere, while the amount of $NO_x$ is smaller at higher temperatures in a reducing atmosphere. The amount of $NO_x$ produced in an oxidizing atmosphere is several tens to several hundreds times that of $NO_x$ produced in a reducing atmosphere at 1400° C. nearly equal to fluid temperature.

While the U-type slag-tap firing boiler is in operation, the pressure in the radiant furnace 106 is controlled by an induced draft fan disposed at the point where gases leave the U-type slag-tap firing boiler so that pressure measured at the pressure measuring nozzle 111 of the radiant furnace 106 is in the range of −0.1 to −0.2 kPa. Pressure measured at the pressure-measuring nozzle 110, i.e., combustion air pressure, is monitored. The difference between the pressure measured at the pressure-measuring nozzle 110 and that measured at the pressure-measuring nozzle 111 correspond to a pressure loss caused by the slag screen 104. Pressure at the pressure-measuring nozzle 110 varies with the thickness of the layer of slag deposited on the screen tubes 104*a* of the slag screen 104, and is dependent on the characteristic of coal and the load.

It is decided that the slag screen 104 has been plugged when the pressure at the pressure-measuring nozzle 110 increases. However, since the pressure at the pressure measuring nozzle 110 is dependent on the characteristic of coal or the load as mentioned above, it is difficult to detect the plugging of the slag screen 104. Since the pressure increases gradually, the slag screen 104 is heavily plugged and the U-type slag-tap firing boiler reaches a serious state where the further operation is impossible before it is known that the slag screen 104 has been plugged.

The present invention has been made to solve those problems in the conventional U-type slag-tap firing boiler in view of the foregoing $NO_x$ generating characteristic of coal combustion, and it is therefore an object of the present invention to provide a U-type slag-tap firing boiler capable of stably maintaining discharging molten slag produced by melting coal ash and of operating at a very low $NO_x$ emission even if the U-type slag-tap firing boiler is provided with small-capacity $NO_x$ removal system or not provided with any $NO_x$ removal system, and method of operating the U-type slag-tap firing boiler. Thus, the present invention is intended to reduce the equipment cost and running cost of the U-type slag-tap firing boiler. The method of operating a U-type slag-tap firing boiler according to the present invention is intended to detect the plugging of the slag screen accurately in a short time, to clean the plugged slag screen and to continue safety operation.

DISCLOSURE OF THE INVENTION

According to the present invention, a method of operating a U-type slag-tap firing boiler, comprises: forming a combustion furnace in a volume so that a temperature of a gas flowing through a slag screen separating a combustion furnace and a radiant furnace disposed below the combustion furnace is maintained in a temperature range that ensures a normal functioning of the slag screen even if an air is supplied through a burner into the combustion furnace at an air ratio below 1; and supplying an air through the burner into the combustion furnace such that the air ratio is below 1, burning a pulverized coal in a fuel-rich combustion mode in the combustion furnace to crate a reducing atmosphere in the combustion furnace and heating an interior of the combustion furnace at a temperature around a fluid temperature, so as to reduce $NO_x$ generation.

Preferably, the volume of the combustion furnace is in a range of about 55 to about 60% of a volume of a combustion furnace designed so that an air ratio at the slag screen is approximately 1, and the air ratio of an air supplied through the burner into the combustion furnace is reduced to approximately 0.8.

Preferably, an over fire air is supplied into the radiant furnace to achieve complete combustion for a further reduction of $NO_x$ emission.

Preferably, a heat flux transferred through a screen tube forming the slag screen is calculated from a difference between temperatures measured respectively by a thermometer disposed near an inlet of the screen tube and a thermometer disposed near an outlet of the screen tube, it is decided that the slag screen is plugged when a calculated heat flux is smaller than a predetermined heat flux, and an air supply rate at which an air is supplied through the burner into the combustion furnace is increased to increase the air ratio beyond a predetermined air ratio so that the heat flux transferred through the screen tube is increased to or above a predetermined heat flux and the slag screen is opened when it is decided that the slag screen is plugged.

Preferably, the predetermined heat flux is 35 $kW/m^2$, and the predetermined air ratio is 0.8.

Preferably, a heat flux transferred through a screen tube forming the slag screen is calculated from a difference between temperatures measured respectively by a thermometer disposed near an inlet of the screen tube and a thermometer disposed near an outlet of the screen tube while the U-type slag-tap firing boiler is in a partial-load operation, it is decided that the slag screen is plugged when a calculated heat flux is smaller than a predetermined heat flux, and an air supply rate at which an air is supplied through the burner into the combustion furnace and fuel supply rate at which fuel is supplied into the combustion furnace are increased to raise a temperature of a gas flowing through the slag screen so that the heat flux transferred through the screen tube is increased to or above a predetermined heat flux and a plug of the slag screen is unclogged when it is decided that the slag screen is plugged.

Preferably, the predetermined heat flux is 35 $kW/m^2$.

Preferably, a heat flux transferred through a screen tube forming the slag screen is calculated from a difference between temperatures measured respectively by a thermometer disposed near an inlet of the screen tube and a thermometer disposed near an outlet of the screen tube, it is decided that the slag screen is plugged when a calculated heat flux is smaller than a predetermined heat flux, and a fluid temperature lowering agent (flux: limestone or hematite) for lowering a fluid temperature is supplied into the combustion furnace to lower a fluid temperature of slag so that a slag melts and flows easily, an amount of slag deposited on the slag screen decreases and a plug of the slag screen is unclogged when it is decided that the slag screen is plugged.

Preferably, the predetermined heat flux is 35 $kW/m^2$.

According to the present invention, a U-type slag-tap firing boiler comprises: a combustion furnace having a burner that burns a pulverized coal; a radiant furnace disposed below the combustion furnace; a slag screen including a screen tube and separating the combustion furnace and the radiant furnace; and a controller for controlling an air supply rate at which an air is supplied through the burner into the combustion furnace and a fuel supply rate at which a fuel is supplied through the burner into the combustion furnace; wherein the combustion furnace is formed in a volume such that a temperature of a gas that flows through the slag screen is maintained in a temperature range that ensures a normal functioning of the slag screen even if an air is supplied through the burner into the combustion furnace at an air ratio below 1, and wherein the controller controls a supply of an air supplied through the burner into the combustion furnace such that the air ratio is below 1 to burn a pulverized coal in a fuel-rich combustion mode in the combustion furnace so that a reducing atmosphere is created in the combustion furnace and an interior of the combustion furnace is heated at a temperature around a fluid temperature to reduce $NO_x$ generation.

Preferably, the volume of the combustion furnace is in a range of about 55 to about 60% of a volume of a combustion furnace designed so that an air ratio at the slag screen is approximately 1, and the controller controls a supply of air through the burner into the combustion furnace so that the air ratio is reduced to approximately 0.8.

Preferably, the U-type slag-tap firing boiler further comprises a nozzle to supply an over fire air into the radiant furnace to achieve a complete combustion for a further reduction of $NO_x$ emission.

Preferably, the U-type slag-tap firing boiler further comprises thermometers disposed near an inlet and an outlet, respectively, of the screen tube, wherein the controller calculates a heat flux transferred through the screen tube from a difference between temperatures measured respectively by the thermometers disposed near the inlet and the outlet of the screen tube, decides that the slag screen is plugged when a calculated heat flux is smaller than a predetermined heat flux, increases the air supply rate at which an air is supplied through the burner into the combustion furnace to increase the air ratio beyond a predetermined air ratio so that the heat flux transferred through the screen tube is increased to or above a predetermined heat flux, so as to unclog a plug of the slag screen.

Preferably, the predetermined heat flux is 35 $kW/m^2$, and the predetermined air ratio is 0.8.

Preferably, the U-type slag-tap firing boiler further comprises thermometers disposed near an inlet and an outlet, respectively, of the screen tube, wherein the controller calculates a heat flux transferred through the screen tube from a difference between temperatures respectively measured by the thermometers disposed near the inlet and the outlet of the screen tube while the U-type slag-tap firing boiler is in a partial-load operation, decides that the slag screen is plugged when a calculated heat flux is smaller than a predetermined heat flux, increases the air supply rate at which an air is supplied through the burner into the combustion furnace and the fuel supply rate at which a fuel is supplied into the combustion furnace to raise a temperature of a gas flowing through the slag screen so that the heat flux transferred through the screen tube is increased to or above the predetermined heat flux, so as to unclog a plug of the slag screen.

Preferably, the predetermined heat flux is 35 $kW/m^2$.

Preferably, the U-type slag-tap firing boiler further comprises thermometers disposed near an inlet and an outlet, respectively, of the screen tube, and the controller calculates a heat flux transferred through the screen tube from a difference between temperatures respectively measured by the thermometers disposed near the inlet and the outlet of the screen tube, decides that the slag screen is plugged when a calculated heat flux is smaller than a predetermined heat flux, and supplies a fluid temperature lowering agent into the combustion furnace to lower a fluid temperature of slag so that a slag melts and flows easily, thereby, an amount of slag deposited on the slag screen decreases and a plug of the slag screen is unclogged.

Preferably, the predetermined heat flux is 35 $kW/m^2$.

BEST MODE FOR CARRYING OUT THE INVENTION

An embodiment of a U-type slag-tap firing boiler and a method of operating the same according to the present invention will be described.

Figure 1:
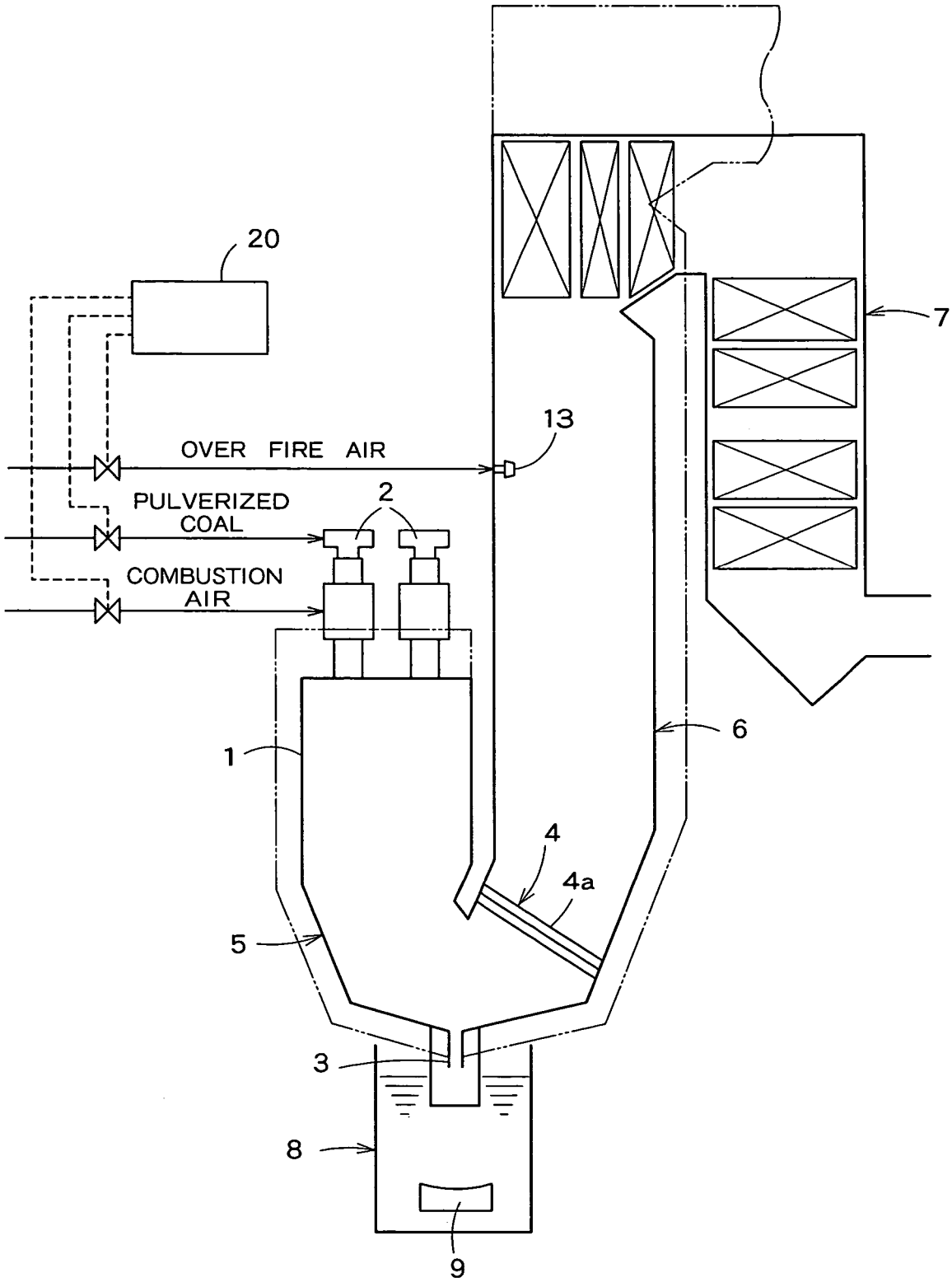
FIG. 1 is a schematic view of a U-type slag-tap firing boiler in a first embodiment according to the present invention.

Referring to FIG. 1 schematically showing a U-type slag-tap firing boiler in the present embodiment, the combustion boiler comprises a combustion furnace 5 including a combustion chamber 1 having water-cooled walls coated with a refractory liner of a refractory material, burners 2 installed to the ceiling of the combustion chamber 1 in a vertical position, a slag-tap 3 formed at the bottom of the combustion chamber 1 to discharge molten slag, and a slag screen 4 formed by arranging multiple screen tubes 4*a*. The slag screen 4 is disposed at a position, where flames flowing downward through the combustion chamber 1 start flowing upward, of the combustion chamber 1. The boiler also comprises a convection heat transfer unit 7 including a radiant furnace 6 having exposed steel walls and disposed below the combustion furnace 5 with respect to the flowing direction of flames, and superheater tubes.

The U-type slag-tap firing boiler in the first embodiment is provided at a part of the radiant furnace 6 below the slag screen 4 with a nozzle 13 for blowing over fire air into the radiant furnace 6. The U-type slag-tap firing boiler is not provided in a part of the combustion furnace 5 above the slag screen 4 with any nozzle for blowing over fire air into the combustion furnace 5.

The U-type slag-tap firing boiler in the first embodiment is provided with a controller 20. The controller 20 controls combustion air supply rate and pulverized coal supply rate at which combustion air and pulverized coal are supplied, respectively, into the combustion furnace 5, and over fire air supply rate at which over fire air is supplied into the radiant furnace 6.

In FIG. 1, imaginary lines indicate the shape of a conventional U-type slag-tap firing boiler designed to blow over fire air into a space above a slag screen to adjust air ratio in the vicinity of the slag screen to 1.

Figure 7:
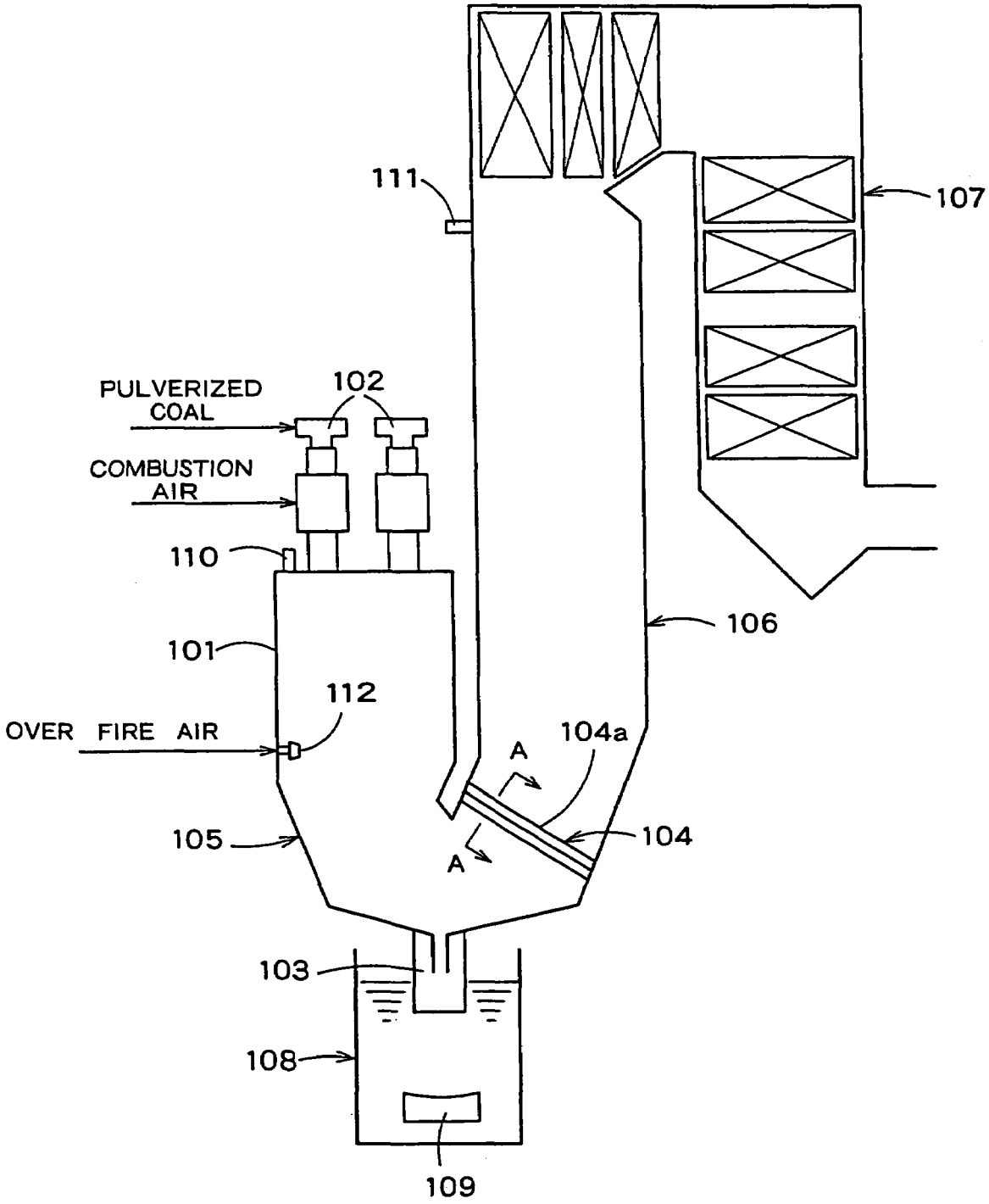
F I G. 7 Related Art
FIG. 7 is a schematic view of a conventional U-type slag-tap firing boiler.
Figure 8:
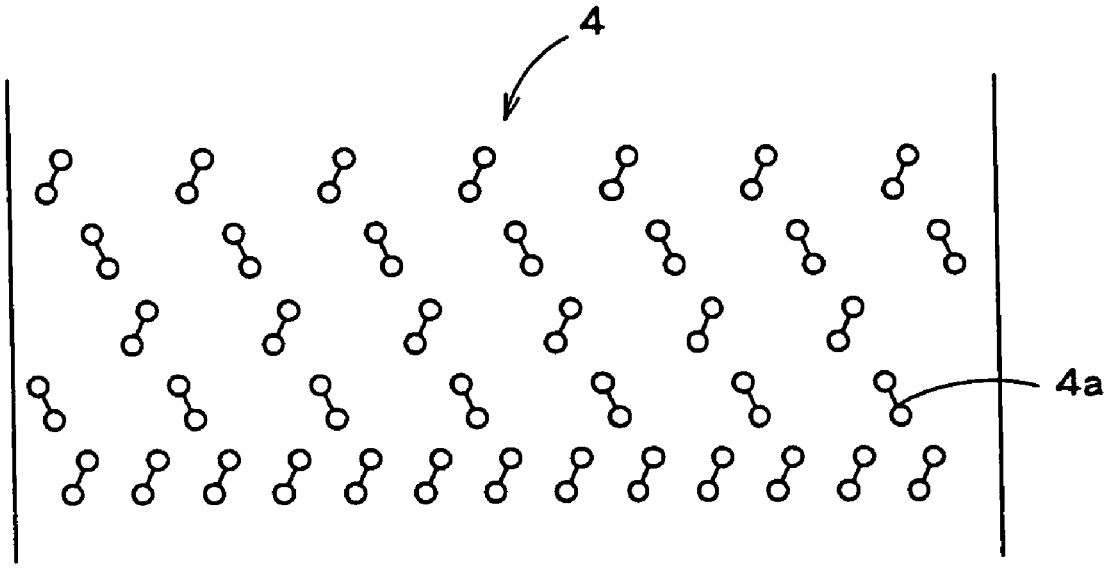
F I G. 8 Related Art
FIG. 8 is an enlarged sectional view taken on the line A—A in FIG. 7.

As mentioned above, when air is supplied to the burners 102 of the conventional U-type slag-tap firing boiler shown in FIG. 7 such that burner air ratio is reduced to 0.8 to reduce $NO_x$, the amount of heat generated in the combustion furnace 105 will decrease by about 30%, the temperature in the combustion furnace 105 drops about 100° C., and the thickness of the slag layer is multiplied by 1.5 to 1.6. Consequently, the temperature of the discharged slag drops, the slag cannot be stably discharged, the deposition of the slag on the screen tubes 104*a* of the slag screen 104 increases, the apparent outside diameter of the screen tubes 104*a* coated with a slag layer increases, and clinker grows in part of the screen tubes 104*a*, thereby, continuous operation becomes difficult. Therefore, the conventional technique blows over fire air through the nozzle 112 into a space above the slag screen 104 to solve such a problem.

The U-type slag-tap firing boiler in the first embodiment does not blow over fire air into a space above the slag screen 4 and, as shown in FIG. 1, the volume of the combustion furnace 5 is about 55 to about 60% of that of the combustion furnace of the conventional U-type slag-tap firing boiler indicated by imaginary lines in FIG. 1.

The combustion furnace 5 is formed in such a reduced volume about 55 to about 60% of that of the combustion furnace of the conventional U-type slag-tap firing boiler for the following reasons. When the controller 20 reduces air supply rate, at which air is supplied to the burners 2, to the order of 0.8, part of pulverized coal reacts with oxygen only to the extent that CO is produced. It is known empirically that heat generating rate when pulverized coal reacts with oxygen in such a mode is on the order of 70% of heat generating rate at which heat is generated when air ratio is 1. Thus, the volume of the combustion chamber 5 necessary to maintain the temperature of the gas flowing through the slag screen 4 at the level of the temperature of the gas that flows through the slag screen in the conventional U-type slag-tap firing boiler without blowing over fire air into a space above the slag screen 4 is $0.7^{3/2}=0.58$ times that of the combustion furnace of the conventional U-type slag-tap firing boiler. Therefore, in this embodiment, the volume of the combustion furnace 5 is in the range of about 55 to about 60% of the combustion furnace 105 of the conventional U-type slag-tap firing boiler. The temperature of the gas at the slag screen 4 is excessively low and the slag screen 4 may be plugged if the volume of the combustion furnace 5 is greater than the upper limit of the range mentioned above. The temperature of the gas at the slag screen 4 is excessively high and the screen tubes 4*a* will be bared and will not be able to function as an ash fusing furnace if the volume of the combustion furnace 5 is smaller than the lower limit of the above-mentioned range.

Thus, the combustion furnace 5 is formed in a reduced volume equal to about 55 to about 60% of that of the combustion furnace of the conventional U-type slag-tap firing boiler designed to blow over fire air into a space above the slag screen such that air ratio at the slag screen is 1, air is supplied through the burners 2 into the combustion chamber 5 such that air ratio is below 1 (for example, about 0.8), pulverized coal is burned in the combustion furnace 5 in a fuel-rich combustion mode to create a reducing atmosphere in the combustion furnace 5 to raise the temperature in the combustion furnace to a temperature around the fluid temperature.

Consequently, the temperature in the combustion furnace 5 is substantially equal to that in the conventional combustion furnace indicated by imaginary lines, slag is deposited in the same thickness, slag can be stably discharged through the slag-tap 3 even though the reducing atmosphere is created in the combustion furnace 5, and slag drops onto a slag conveyor 9 installed in a slag quenching water bath 8 and is carried away. At the same time, $NO_x$ generation in the combustion furnace 5 decreases. Nitrogen and volatile components of pulverized coal blown into the combustion furnace 5 by the burners 2 are converted into HCN and $NH_3$, and part of the nitrogen contained in pulverized coal is oxidized to produce NO. In the high-temperature reducing atmosphere, part of NO is reduced into $N_2$, so that $NO_x$ decreases.

Pulverized coal is burned in the combustion furnace 5 in a fuel-rich combustion mode in which the ratio of air to fuel is smaller than that specified by a stoichiometric air-fuel ratio, and CO gas produced by combustion flows into the radiant furnace 6. Over fire air is blown through the nozzle 13 into a space suitable for completely burning CO, such as a space, where the temperature is 1200° C. or above, in the radiant furnace 6 for complete combustion. Thus, $NO_x$ emission is further decreased.

Figure 2:
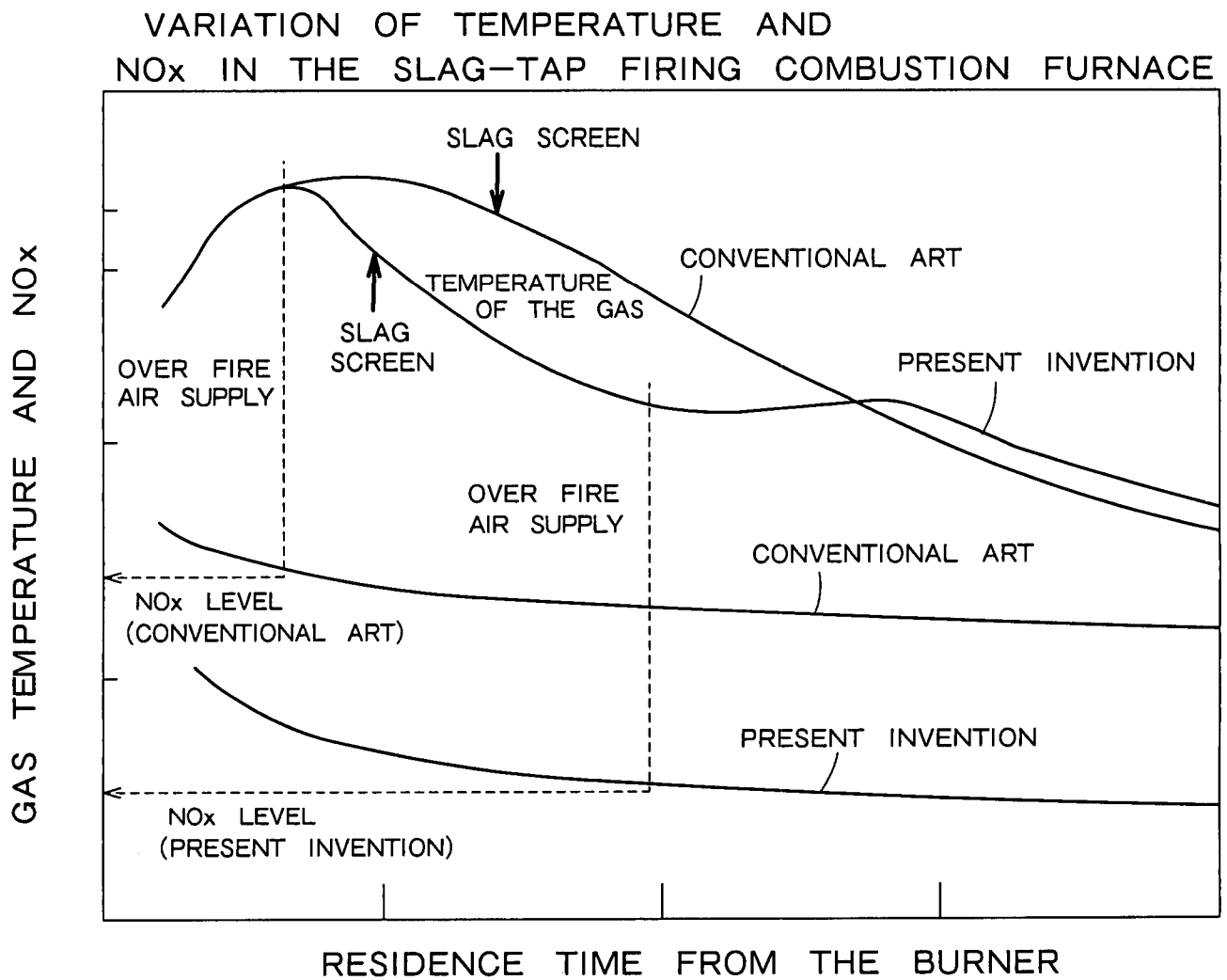
FIG. 2 is a graph showing curves representing the variation of $NO_x$ concentration with distance from a position where burners are placed when burner air ratio is reduced by a boiler operating method according to the present invention that blows over fire air into a radiant furnace below a slag screen, and a conventional boiler operating method that blows over fire air into a combustion furnace above a slag screen, and the variation of the temperature of combustion gas when over fire air is flown into the radiant furnace by the boiler operating method according to the present invention and when over fire air is blown into the combustion furnace by the conventional boiler operating method.

FIG. 2 shows the variation of $NO_x$ concentration at a low burner air ratio when the conventional U-type slag-tap firing boiler shown in FIG. 7 is operated by the conventional method that blows over fire air through the nozzle 112 into the combustion furnace 105 above the slag screen 104, and when the U-type slag-tap firing boiler in the first embodiment shown in FIG. 1 is operated by the method according to the present embodiment that blows over fire air through the nozzle 13 into the radiant furnace 6.

As obvious from FIG. 2, the method according to the present embodiment, which reduces burner air ratio and blows over fire air through the nozzle 13 into the radiant furnace 6 below the slag screen 4, has a high $NO_x$ reducing effect. The consequence of change in the position where over fire air is supplied without changing burner air ratio with residence time from the burners 2 is also shown in FIG. 2. The $NO_x$ reducing effect increases with residence time from the burner 2 to the supply of over fire air.

Another embodiment of a U-type slag-tap firing boiler and a method of operating the same according to the present invention will be described.

Figure 3:
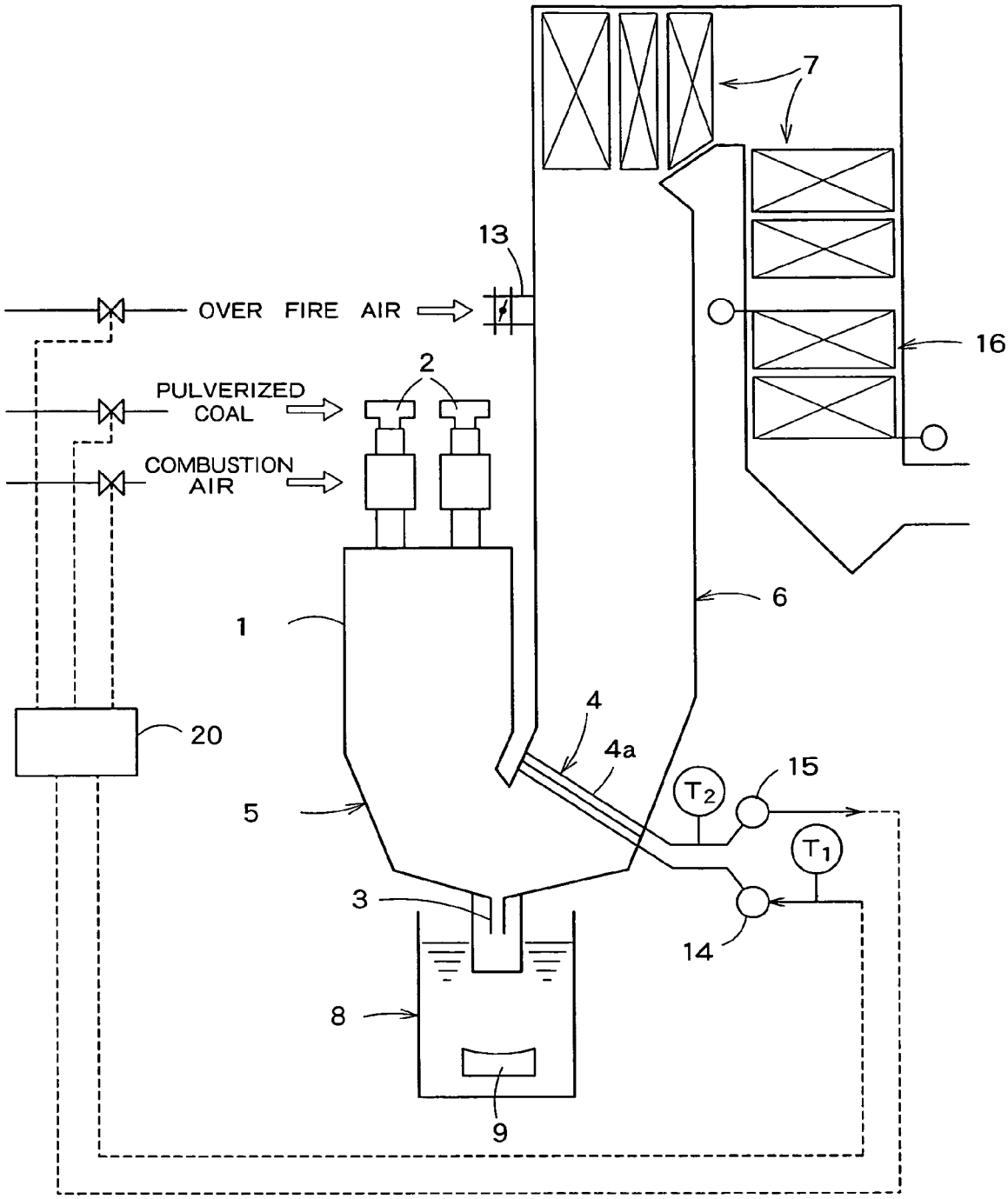
FIG. 3 is a schematic view of a U-type slag-tap firing boiler in a second embodiment according to the present invention.
Figure 4:
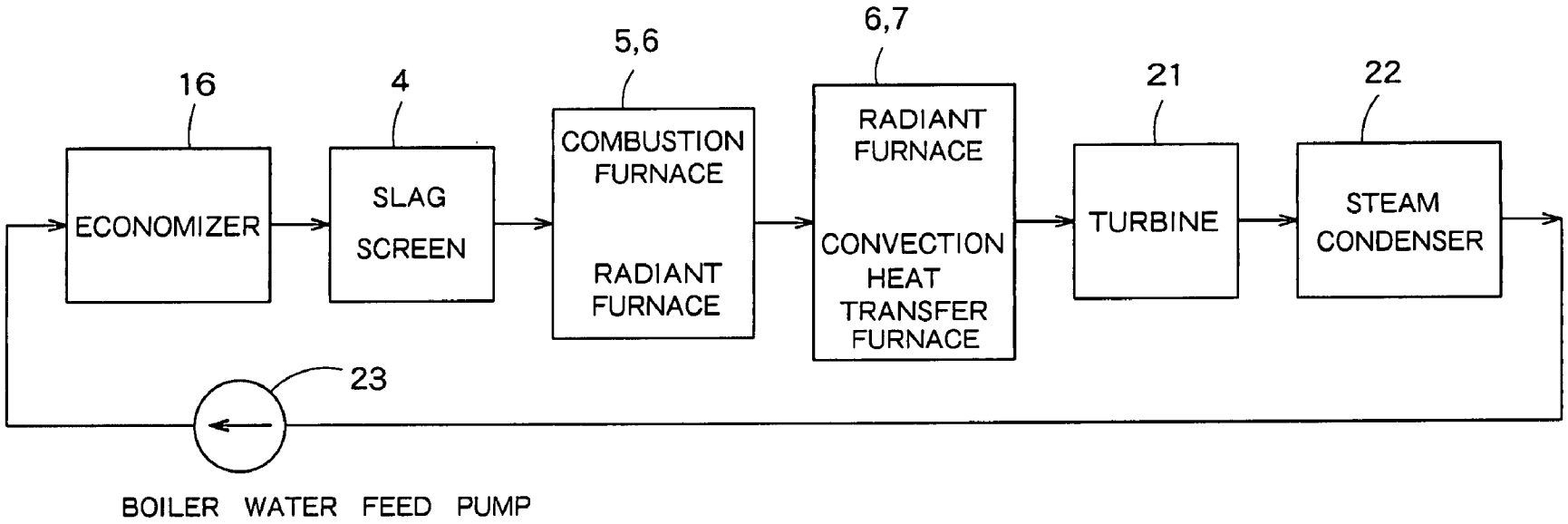
FIG. 4 is a block diagram of an evaporation system included in the U-type slag-tap firing boiler shown in FIG. 3.

FIG. 3 schematically shows a U-type slag-tap firing boiler in the present embodiment. The U-type slag-tap firing boiler has complicated constitution and hence the U-type slag-tap firing boiler, in general, is a once-through boiler. The temperature of water passed through an economizer 16 is lower than the evaporating temperature. Therefore, as shown in FIG. 4, an evaporation system is constructed such that water passed through the economizer 16 flows through a slag screen 4, a combustion furnace 5 and a radiant furnace 6 to a convection heat transfer unit 7. Shown also in FIG. 4 are a turbine 21, a steam condenser 22 and a boiler feed pump 23.

In the present embodiment having the foregoing evaporation system, a thermometer $T_1$ is placed at a position above and near a screen tube inlet header 14 for the slag screen 4, and a thermometer $T_2$ is placed at a position above and near a screen tube outlet header 15. The thermometers $T_1$ and $T_2$ measure the respective temperatures of the screen tube inlet header 14 and the screen tube outlet header 15, respectively. A controller 20 calculates heat flux transferred through screen tubes 4*a* from the difference between the temperatures measured by the thermometers $T_1$ and $T_2$, and monitors heat flux.

Heat flux transferred through the screen tubes 4*a* is calculated by using the following expression.

$$\text{(Heat flux)}=1.163\times\text{(Water feed rate)}\times\text{(Specific heat of water)}\times\{\text{(Outlet temperature)}-\text{(Inlet temperature)}\}/\text{(Surface area of screen tubes } (W/m^2))$$

Heat flux transferred through the screen tubes 4*a* of the U-type slag-tap firing boiler is dependent on the characteristic of coal or on load. Normally, heat flux is in the range of 140 to 145 kW/m$^2$. Heat flux decreases to or below 35 kW/m$^2$ when the slag screen is plugged. Therefore calculated heat flux is monitored and it is decided that the slag screen 4 is plugged when the calculated heat flux decreases to or below 35 kW/m$^2$.

Reasons for detecting the plugging of the slag screen 4 through the calculation of heat flux transferred through the screen tubes 4*a* of the slag screen 4 and the monitoring of calculated heat flux will be described hereunder.

Figure 5:
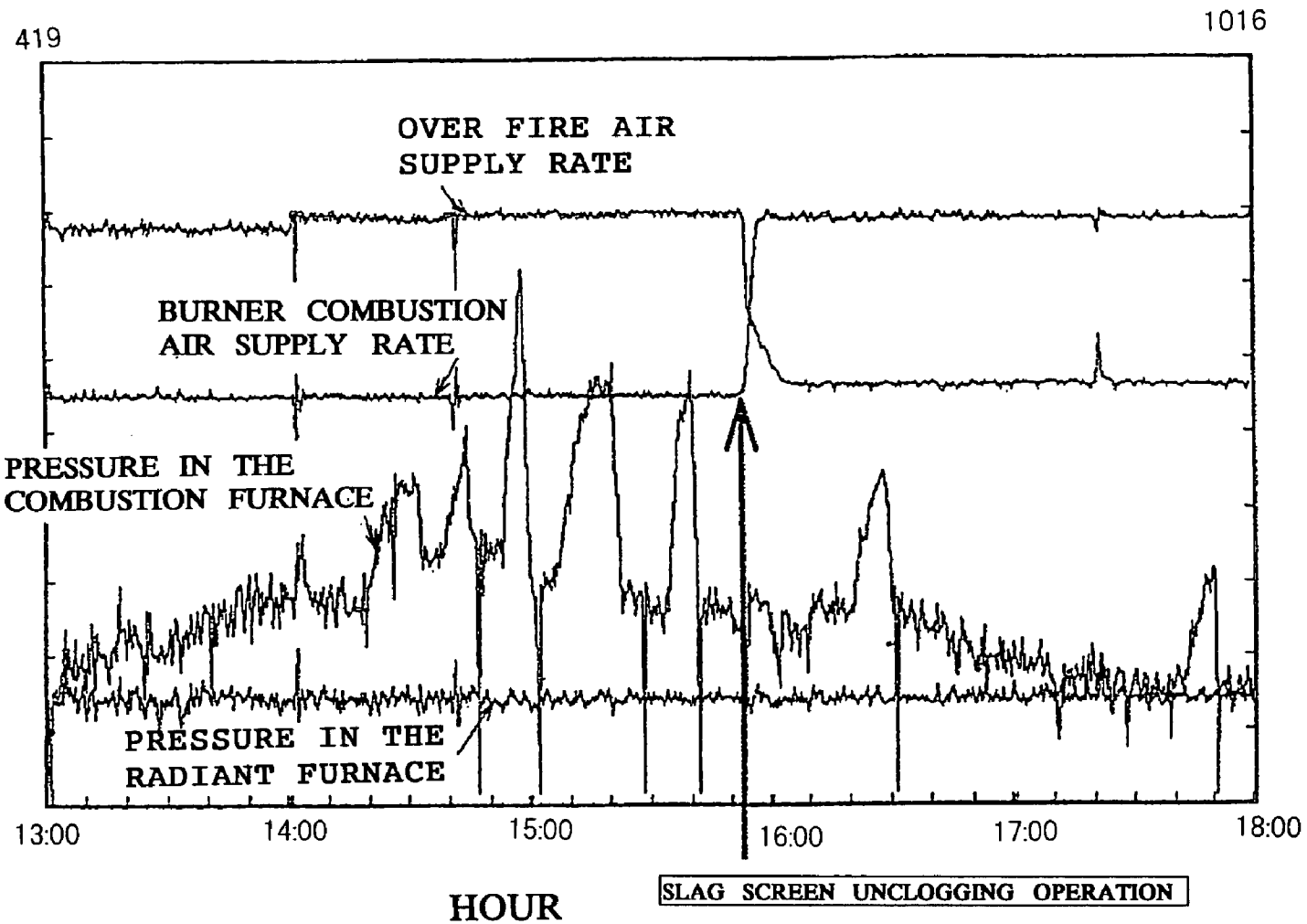
FIG. 5 is a graph showing modes of variation of pressure in a combustion furnace, pressure in a radiant furnace, burner combustion air flow rate, and over fire air flow rate with time when conventional techniques are applied to slag screen unclogging operation while a U-type slag-tap firing boiler is in operation.

The U-type slag-tap firing boiler shown in FIG. 1 is operated by the aforesaid method for a low $NO_x$ operation by supplying air through the burners 2 into the combustion furnace 5 such that air ratio is below 1. FIG. 5 shows that, whereas the pressure in the radiant furnace 6 changes scarcely between 13:00 hr and 18:00 hr, the pressure in the combustion furnace 5 increases gradually, clinker grow on or below the slag screen 4, and pressure loss increases.

As shown in FIG. 5, this method increases burner combustion air supply rate at which air is supplied into the combustion furnace 5 and also reduces the flow rate of over fire air supplied into the radiant furnace 6 at about 16:00 hr about three hours after the start of operation to increase combustion in the combustion furnace 5 and to decrease the pressure in the combustion furnace 5 for a slag screen unclogging operation.

Figure 6:
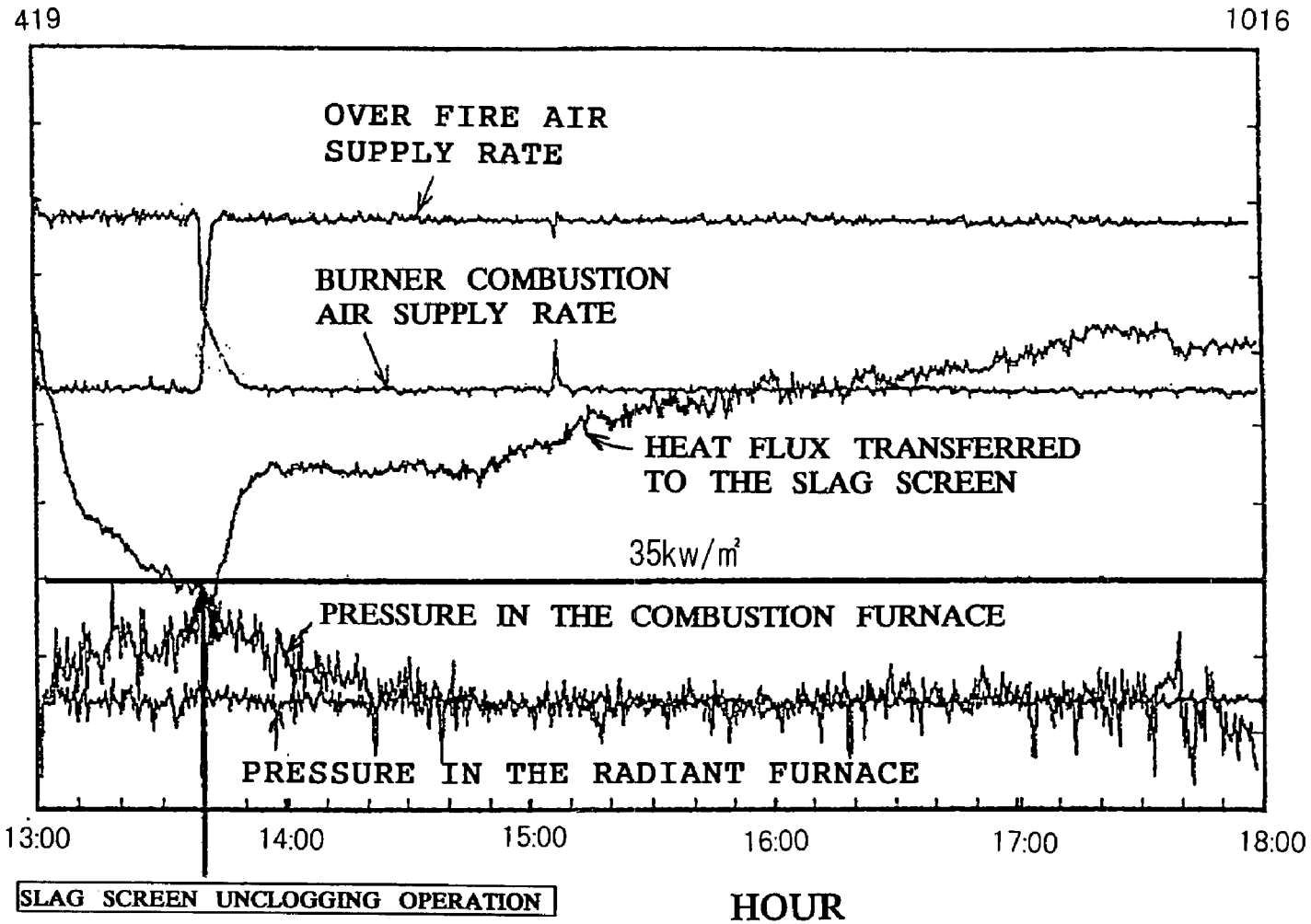
FIG. 6 is a graph showing modes of variation of pressure in a combustion furnace, pressure in a radiant furnace, burner combustion air flow rate, over fire air flow rate, and heat flux transferred through a slag screen with time when techniques according to the present invention are applied to slag screen unclogging operation while a U-type slag-tap firing boiler is in operation.

FIG. 6 is a graph showing modes of variation of pressure in the combustion furnace, pressure in the radiant furnace, burner combustion air flow rate, over fire air flow rate, and heat flux transferred through the slag screen with time when a slag screen unclogging operation according to the present embodiment is performed while the U-type slag-tap firing boiler shown in FIG. 3 is in operation. As obvious from FIG. 6, heat flux transferred through the slag screen 4 decreases to or below 35 kW/m$^2$ and the slag screen 4 is plugged around 13:30 hr when the pressure in the combustion furnace 5 starts to increase gradually.

In the present embodiment, as shown in FIG. 6, when the reduction of heat flux transferred through the slag screen 4 to or below 35 kW/m$^2$ is detected, burner combustion air supply rate is increased and over fire air supply rate at which over fire air is supplied into the radiant furnace 6 is decreased to increase heat flux that is transferred through the slag screen 4 to or above 35 kW/m$^2$ to unclog a plug of the slag screen 4. Where as it takes about three hours before deciding that the slag screen 4 is plugged when the pressure in the combustion furnace 5 is monitored, the plugging of the slag screen 4 can be decided in a short time by monitoring heat flux that is transferred through the slag screen 4 and measures for unclogging a plug of the slag screen 4 can be immediately taken. Upon the detection of the plugging of the slag screen 4, combustion air supply rate at which air is supplied through the burners 2 into the combustion furnace 5 is increased, over fire air supply rate at which over fire air is supplied into the radiant furnace 6 is decreased, air ratio in the combustion furnace 5 is increased beyond 0.8 as shown in FIG. 6 to unclog a plug of the slag screen 4 by increasing heat flux transferred through the screen tubes 4*a* of the slag screen 4 to or beyond 35 kW/m$^2$.

This operation increases $NO_x$ concentration at the exit of the U-type slag-tap firing boiler. Therefore, the consumption of ammonia is increased if the U-type slag-tap firing boiler is provided with a $NO_x$ removal system, or air ratio in the furnace is increased to an extent meeting a prescribed $NO_x$ concentration if the U-type slag-tap firing boiler is not provided with any $NO_x$ removal system.

When the foregoing low-$NO_x$ operation is performed while the U-type slag-tap firing boiler is in a partial-load operation, fuel supply and air supply through the burners 2 into the combustion chamber 5 are increased immediately after the detection of the plugging of the slag screen 4 to unclog a plug of the slag screen 4 by raising the temperature of the gas flowing through the slag screen 4 and increasing heat flux transferred through the screen tubes 4*a* of the slag screen 4 to or above 35 kW/m$^2$. Power generation increases when the U-type slag-tap firing boiler is thus controlled. In such a case, load on other boilers of the system may be reduced.

In another example, a fluid temperature lowering agent for lowering fluid temperature of slag is supplied into the combustion furnace 5 immediately after the detection of plugging of the slag screen 4 while the U-type slag-tap firing boiler is in the low-$NO_x$ operation to lower the fluid temperature of slag so that slag melts and flows easily through the slag-tap 3, the amount of slag deposited on the slag screen 4 decreases and the slag screen 4 is opened. The fluid temperature lowering agent is, for example, limestone, dolomite, iron ore or iron oxide powder. For example, when 1%, 2% and 2.8% of limestone to 100% of pulverized coal is supplied into the combustion chamber 5, the temperature in the combustion chamber 5 drops about 60° C., 90° C. and 120° C., respectively.

As apparent from the foregoing description, the U-type slag-tap firing boilers and methods of operating the same embodying the present invention maintain stable discharge of molten coal ash slag by creating the high-temperature reducing atmosphere in the combustion chamber 5, and reduce $NO_x$ by extending residence time for which CO produced by the incomplete burning of pulverized coal stays before over fire air is blown into the radiant furnace 6 below the combustion furnace 5. Thereby, the present embodiments decrease $NO_x$ emission to about ⅓ of $NO_x$ emission that occurs when the conventional U-type slag-tap firing boiler is operated by the conventional method. The $NO_x$ removal system that is needed by the U-type slag-tap firing boiler can be omitted, or may be of a small $NO_x$ removing capacity. Consequently, the equipment cost and running cost of the U-type slag-tap firing boiler can be reduced.

The U-type slag-tap firing boilers and methods of operating the same embodying the present invention are able to detect the plugging of the slag screen accurately in a short time while the U-type slag-tap firing boiler is in the low $NO_x$ operation. Heat flux transferred through the screen tubes 4*a* of the slag screen 4 is increased or a fluid temperature lowering agent for lowering fluid temperature is supplied into the combustion furnace to lower the fluid temperature of slag so that slag melts and flows easily, the amount of slag deposited on the slag screen 4 decreases and the slag screen 4 is opened immediately after the detection of the plugging of the slag screen 4. Thus, the U-type slag-tap firing boiler is able to continue operation safely.

INDUSTRIAL APPLICABILITY

The present invention is applicable to the U-type slag-tap firing boiler and to a method of operating the same.

The invention claimed is:

1. A method of operating a U-type slag-tap firing boiler, comprising:

forming a combustion furnace in a volume so that a temperature of a gas flowing through a slag screen separating a combustion furnace and a radiant furnace disposed below the combustion furnace is maintained in a temperature range that ensures a normal functioning of the slag screen even if an air is supplied through a burner into the combustion furnace at an air ratio below 1, and no additional air is supplied, the volume of the combustion furnace being in a range of about 55% to 60% of a volume of a combustion furnace which is formed which is formed above the slag screen and is designed so that an air ratio at the slag screen is approximately 1 so as to achieve a complete combustion of a pulverized coal in the combustion furnace;

supplying an air through the burner into the combustion furnace such that the air ratio is below 1;

burning a pulverized coal in a fuel-rich combustion mode in the combustion furnace to create a reducing atmosphere substantially throughout the combustion furnace from the burner to the slag screen; and heating an interior of the combustion furnace at a temperature around a fluid temperature, so as to reduce $NO_x$ generation.

2. The method of operating a U-type slag-tap firing boiler according to claim 1, wherein the air ratio of an air supplied through the burner into the combustion furnace is reduced to approximately 0.8.

3. The method of operating a U-type slag-tap firing boiler according to claim 1, wherein an over fire air is supplied into the radiant furnace to achieve complete combustion for a further reduction of $NO_x$ emission.

4. The method of operating a U-type slag-tap firing boiler according to claim 1, wherein a heat flux transferred through a screen tube forming the slag screen is calculated from a difference between temperatures measured respectively by a thermometer disposed near an inlet of the screen tube and a thermometer disposed near an outlet of the screen tube, it is decided that the slag screen is plugged when a calculated heat flux is smaller than a predetermined heat flux, and an air supply rate at which an air is supplied through the burner into the combustion furnace is increased to increase the air ratio beyond a predetermined air ratio so that the heat flux transferred through the screen tube is increased to or above a predetermined heat flux and the slag screen is opened when it is decided that the slag screen is plugged.

5. The method of operating a U-type slag-tap firing boiler according to claim 4, wherein the predetermined heat flux is 35 $kW/m^2$, and the predetermined air ratio is 0.8.

6. The method of operating a U-type slag-tap firing boiler according to claim 1, wherein a heat flux transferred through a screen tube forming the slag screen is calculated from a difference between temperatures measured respectively by a thermometer disposed near an inlet of the screen tube and a thermometer disposed near an outlet of the screen tube while the U-type slag-tap firing boiler is in a partial-load operation, it is decided that the slag screen is plugged when a calculated heat flux is smaller than a predetermined heat flux, and an air supply rate at which an air is supplied through the burner into the combustion furnace and fuel supply rate at which fuel is supplied into the combustion furnace are increased to raise a temperature of a gas flowing through the slag screen so that the heat flux transferred through the screen tube is increased to or above a predetermined heat flux and a plug of the slag screen is unclogged when it is decided that the slag screen is plugged.

7. The method of operating a U-type slag-tap firing boiler according to claim 6, wherein the predetermined heat flux is 35 $kW/m^2$.

8. The method of operating a U-type slag-tap firing boiler according to claim 1, wherein a heat flux transferred through a screen tube forming the slag screen is calculated from a difference between temperatures measured respectively by a thermometer disposed near an inlet of the screen tube and a thermometer disposed near an outlet of the screen tube, it is decided that the slag screen is plugged when a calculated heat flux is smaller than a predetermined heat flux, and a fluid temperature lowering agent for lowering a fluid temperature is supplied into the combustion furnace to lower a fluid temperature of slag so that a slag melts and flows easily, an amount of slag deposited on the slag screen decreases and a plug of the slag screen is unclogged when it is decided that the slag screen is plugged.

9. The method of operating a U-type slag-tap firing boiler according to claim 8, wherein the predetermined heat flux is 35 $kW/m^2$.

10. A U-type slag-tap firing boiler comprising:

a combustion furnace having a burner that burns a pulverized coal;

a radiant furnace disposed below the combustion furnace;

a slag screen including a screen tube and separating the combustion furnace and the radiant furnace; and a controller for controlling an air supply rate at which an air is supplied through the burner into the combustion furnace and a fuel supply rate at which a fuel is supplied through the burner into the combustion furnace;

wherein the combustion furnace is formed in a volume such that a temperature of a gas that flows through the slag screen is maintained in a temperature range that ensures a normal functioning of the slag screen even if an air is supplied through the burner into the combustion furnace at an air ratio below 1, and no additional air is supplied, the volume of the combustion furnace being in a range of about 55% to 60% of a volume of a combustion furnace which is formed which is formed above the slag screen and is designed so that an air ratio at the slag screen is approximately 1 so as to achieve a complete combustion of a pulverized coal in the combustion furnace, and wherein the controller controls a supply of an air supplied through the burner into the combustion furnace such that the air ratio is below 1 to burn a pulverized coal in a fuel-rich combustion mode in the combustion furnace so that a reducing atmosphere is created substantially throughout the combustion furnace from the burner to the slag screen and an interior of the combustion furnace is heated at a temperature around a fluid temperature to reduce $NO_x$ generation.

11. The U-type slag-tap firing boiler according to claim 10, wherein the controller controls a supply of air through the burner into the combustion furnace so that the air ratio is reduced to approximately 0.8.

12. The U-type slag-tap firing boiler according to claim 10, further comprising a nozzle to supply an over fire air into the radiant furnace to achieve a complete combustion for a further reduction of $NO_x$ emission.

13. The U-type slag-tap firing boiler according to claim 10, further comprising thermometers disposed near an inlet and an outlet, respectively, of the screen tube, wherein the controller calculates a heat flux transferred through the screen tube from a difference between temperatures measured respectively by the thermometers disposed near the inlet and the outlet of the screen tube, decides that the slag screen is plugged when a calculated heat flux is smaller than a predetermined heat flux, increases the air supply rate at which an air is supplied through the burner into the combustion furnace to increase the air ratio beyond a predetermined air ratio so that the heat flux transferred through the screen tube is increased to or above a predetermined heat flux, so as to unclog a plug of the slag screen.

14. The U-type slag-tap firing boiler according to claim 13, wherein the predetermined heat flux is 35 $kW/m^2$, and the predetermined air ratio is 0.8.

15. The U-type slag-tap firing boiler according to claim 10, further comprising thermometers disposed near an inlet and an outlet, respectively, of the screen tube, wherein the controller calculates a heat flux transferred through the screen tube from a difference between temperatures respectively measured by the thermometers disposed near the inlet and the outlet of the screen tube while the U-type slag-tap firing boiler is in a partial-load operation, decides that the slag screen is plugged when a calculated heat flux is smaller than a predetermined heat flux, increases the air supply rate at which an air is supplied through the burner into the combustion furnace and the fuel supply rate at which a fuel is supplied into the combustion furnace to raise a temperature of a gas flowing through the slag screen so that the heat flux transferred through the screen tube is increased to or above the predetermined heat flux, so as to unclog a plug of the slag screen.

16. The U-type slag-tap firing boiler according to claim 15, wherein the predetermined heat flux is 35 $kW/m^2$.

17. The U-type slag-tap firing boiler according to claim 10, further comprising thermometers disposed near an inlet and an outlet, respectively, of the screen tube, and the controller calculates a heat flux transferred through the screen tube from a difference between temperatures respectively measured by the thermometers disposed near the inlet and the outlet of the screen tube, decides that the slag screen is plugged when a calculated heat flux is smaller than a predetermined heat flux, and supplies a fluid temperature lowering agent into the combustion furnace to lower a fluid temperature of slag so that a slag melts and flows easily, thereby, an amount of slag deposited on the slag screen decreases and a plug of the slag screen is unclogged.

18. The U-type slag-tap firing boiler according to claim 17, wherein the predetermined heat flux is 35 $kW/m^2$.

* * * * *